United States Patent [19]

Derksen et al.

[11] Patent Number: 4,957,373

[45] Date of Patent: Sep. 18, 1990

[54] METHOD AND APPARATUS FOR MIXING BULK MATERIALS IN POWDERED OR GRANULAR FORM

[75] Inventors: Michael Derksen, Lüdenscheid; Joachim Domke, Menden, both of Fed. Rep. of Germany

[73] Assignee: Herfeld GmbH & Co. KG, Fed. Rep. of Germany

[21] Appl. No.: 408,551

[22] Filed: Sep. 18, 1989

[30] Foreign Application Priority Data

Oct. 24, 1988 [DE] Fed. Rep. of Germany ..... 3836216

[51] Int. Cl.[5] ..... B01F 9/06

[52] U.S. Cl. ..... 366/197; 366/206; 366/219

[58] Field of Search ..... 366/197, 199, 200, 208, 366/209, 210, 211, 213, 214, 218, 63, 62, 61, 60, 53, 54, 206

[56] References Cited

U.S. PATENT DOCUMENTS 3,174,728 3/1965 Mack ..... 366/213

3,224,741 12/1965 Muench ..... 366/197

4,671,666 6/1987 Herfeld ..... 366/197

4,676,658 6/1987 Herfeld ..... 366/197

*Primary Examiner*—Robert W. Jenkins

*Attorney, Agent, or Firm*—Learman & McCulloch

[57] ABSTRACT

A method and apparatus for mixing powdered or granular materials wherein a mixing vessel having a vertical axis is rotated 180° about a horizontal axis from an initial upright position to an inverted mixing position, then rotated to an intermediate position angularly spaced from the initial position by an acute angle, and then returned to the initial position. The movement of the vessel from the initial position to the mixing position is faster than its movement from the mixing position to the intermediate position so that, when the vessel reaches the intermediate position, the surface of the material forms an angle to the vertical that is less than the acute angle. The vessel is maintained in the intermediate position for such a period of time that, when the vessel returns to its initial position, the surface of the material is substantially horizontal.

19 Claims, 2 Drawing Sheets

METHOD AND APPARATUS FOR MIXING BULK MATERIALS IN POWDERED OR GRANULAR FORM

The invention relates to a method and to apparatus for mixing bulk materials in powdered or granular form.

BACKGROUND OF THE INVENTION

Known method and apparatus of the general class to which the invention relates are disclosed for example in DE-A-36 37 607. When the mixing vessel of the known construction is being pivoted back after the mixing operation it is first of all pivoted by a predetermined angle beyond the starting position into an intermediate position and only from there is it pivoted back into the starting position. By this measure the contents of the mixing vessel can be exploited to the full and at the same time the throughput capacity of the mixing apparatus can be substantially improved.

SUMMARY OF THE INVENTION

The object of the invention is to make further improvements to the known method and mixing apparatus so that on the one hand the throughput capacity of the mixing apparatus is further increased but on the other hand when the mixing vessel is being pivoted back out of the mixing position it attains the starting position with greater precision which is of crucial importance for the satisfactory functioning of the mixing apparatus, particularly for the connection and release of the two separable mixing vessel parts.

THE DRAWINGS

One embodiment of mixing apparatus for carrying out the mixing method according to the invention will be explained in greater detail below with the aid of the accompanying drawings, wherein.

DETAILED DESCRIPTION

Figure 1:
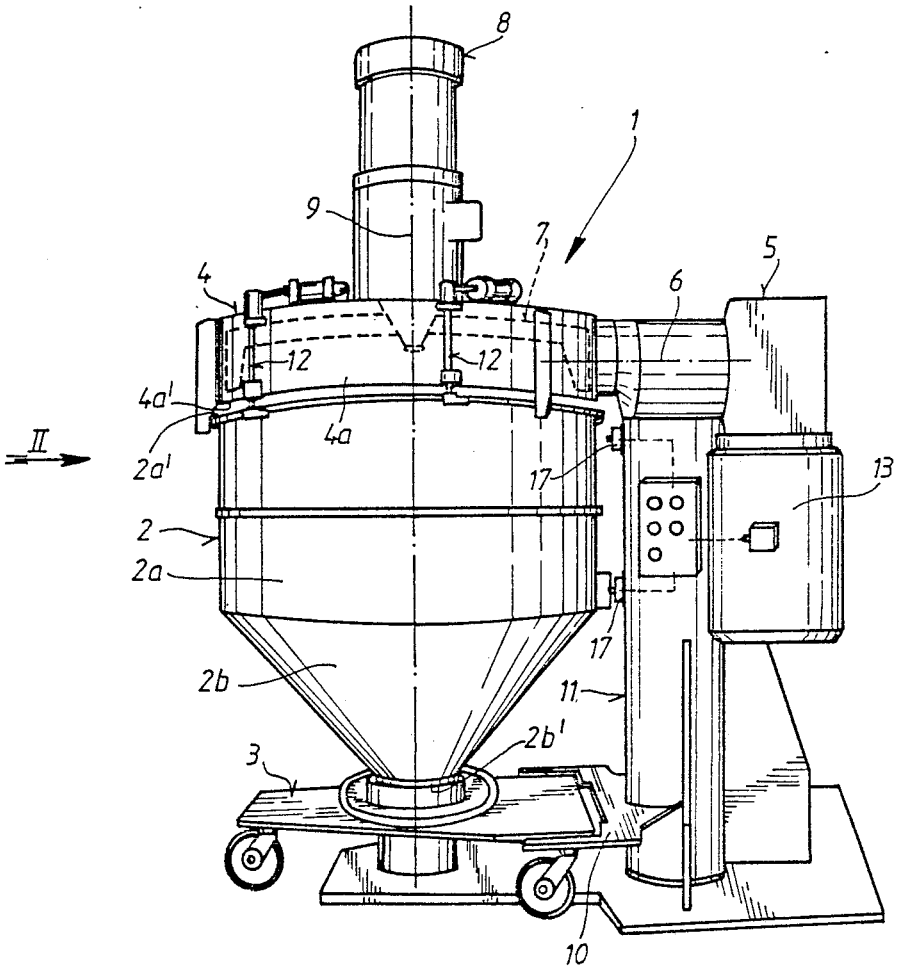
FIG. 1 shows a side view of the mixing apparatus.

First of all the general construction of mixing apparatus 1 according to the invention will be explained with the aid of FIGS. 1 and 2.

This mixing apparatus 1 contains a first mixing vessel part 2 which has in a manner which is known per se an upper vessel section 2*a* which is for example cylindrical and a funnel-shaped lower vessel section 2*b* which separably connects directly onto the bottom of the upper section;

The filling end 2*a*′, which is open at the top, of the upper vessel section 2*a* enables filling this first mixing vessel part 2 with bulk material. This first mixing vessel part 2 can be transported in any suitable manner in order to convey it from a charging point below several storage vessels and into the region of the actual mixing apparatus 1. In the illustrated embodiment this transportability is provided in a manner which is known per se by a type of transport platform or travelling pallet 3 on which the first mixing vessel part 2 with the lower outlet end 2*b*′ of its lower vessel section 2*b* is set down so that it can be lifted off.

The mixing apparatus 1 also contains a second mixing vessel part 4 which is mounted on a pivot drive 5 and thus can be moved pivotally about a horizontal pivot axis 6, as will be explained in greater detail below. Mixing tools or blades 7, which can be driven by a separate drive unit 8 so as to rotate about the vessel axis 9 which is vertical in the starting position of the mixing apparatus 1, are also arranged in a manner which is known per se in the second mixing vessel part 4, which is of bowl-shaped construction.

In the mixing operation the first mixing vessel part 2 which is filled with a bulk material charge is moved under the second mixing vessel part 4 which is open in the starting position in such a way that the vertical central axes of both mixing vessel parts 2, 4 coincide with the vessel axis, and the first mixing vessel part 2 is still supported on the travelling pallet 3 which is received in a type of fork 10 of a column-like stand 11 which supports the pivot drive 5 and the second mixing vessel part 4 for the purpose of aligning the first, currently lower, mixing vessel part 2 with respect to the second, currently upper, mixing vessel part 4. By means of a suitable known lifting arrangement the first, currently lower, mixing vessel part 2 is lifted off the travelling pallet 3 and the edge of its upper filling end 2*a*′ is pressed against the outer edge 4*a*′ of the open end 4*a* of the second mixing vessel part 4 which is currently directed downwards. In this position the first mixing vessel part 2 is gripped by suitable clamps 12 and clamped to the second mixing vessel section 4 so that one single mixing vessel with a vertical vessel axis 9 is created. In a manner which is known per se the clamps 12 can be constructed, actuated (for example by pressure medium drives) and distributed and mounted over the periphery of the second mixing vessel part 4.

Figure 2:
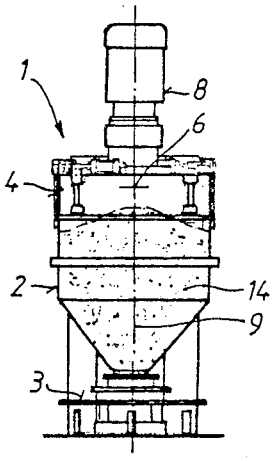
FIGS. 2 to 6 show similar front views of the mixing apparatus corresponding to the arrow II in FIG. 1, in various operating positions of the mixing vessel from the start to the end of a complete mixing operation.
Figure 3:
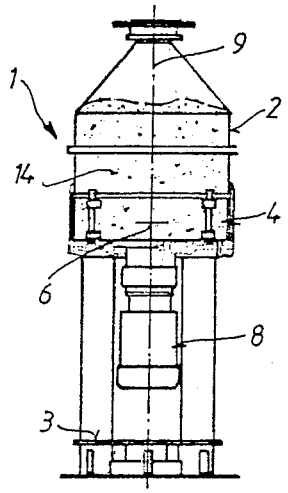

The pivot drive 5 serves to pivot the mixing vessel, consisting of the mixing vessel parts 2 and 4 which are clamped together, by 180° about the horizontal pivot axis 6 out of the initial position shown in FIGS. 1 and 2 in which a vertical plane coincident with the vessel axis 9 passes, and into the mixing position shown in FIG. 3, in which the second mixing vessel part 4 then forms the vessel base and the first mixing vessel part 2 forms a sort of cover dome for the mixing vessel. Furthermore, after the mixing operation the mixing vessel (2, 4) is pivoted back into its starting or initial position with the aid of the pivot drive 5.

For this purpose the pivot drive contains a drive motor 13 which is constructed in the form of a turning gear motor or a brake motor. It is also important that this drive motor 13 can be switched between two speed ranges which are kept at such a magnitude that when the mixing vessel (2, 4) is being pivoted back into the stable starting position (FIGS. 1, 2 and 6) it can operate at two different predeterminable tilting speeds. These two tilting speeds are chosen in such a way that when the mixing vessel is pivoted back it can be pivoted at an increased first tilting speed out of the mixing position (FIG. 3) initially past the starting position (FIG. 4) and hence into an intermediate position (FIG. 5) in which the mixing vessel (2, 4) rests for approximately 2–8 seconds, preferably approximately 4–6 seconds, and more preferably approximately 5 seconds, and only from this intermediate position (FIG. 5) is the mixing vessel pivoted at the second tilting speed (opposite direction of rotation to that of the first tilting speed) in the opposite direction into the stable starting position (FIG. 6).

A particularly reliable pivoting back of the mixing vessel first of all into the intermediate position and from there into the stable starting position can be ensured not only by the construction of the drive motor 13 as a brake motor but also by approach end switches 17 which are known per se, and are arranged at appropriate points and are connected by wiring to the drive motor 13 for switching between speeds (as indicated in FIG. 1).

The way in which the mixing method described above is carried out with the aid of this mixing apparatus 1 will be readily understood from the foregoing explanations of the construction and manner of functioning of the mixing apparatus 1. It is therefore sufficient merely to explain the individual operating positions between the beginning and the end of a complete mixing operation according to the representations in FIGS. 2–6.

In FIG. 2 the mixing vessel (2, 4) is in its starting position with a vertical axis, and in this position the entire bulk material charge 14 is still located in the lower, first mixing vessel part 2.

According to FIG. 3 the mixing vessel (2, 4) is pivoted by 180° about the horizontal axis 6 into the mixing position in which the bulk material charge 14 is supported on the second mixing vessel part 4 which now forms the vessel base, so that the bulk material charge is intensively intermixed by the rotating mixing tools 7 (FIG. 1).

Figure 4:
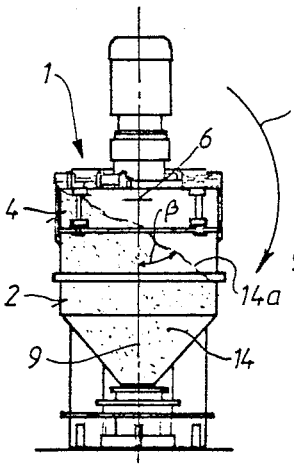
Figure 5:
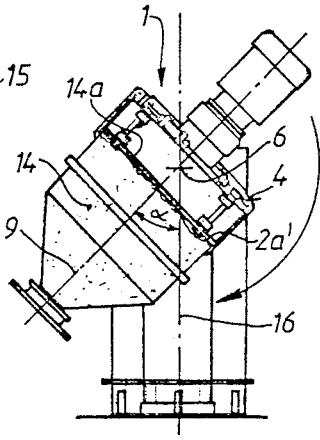
Figure 6:
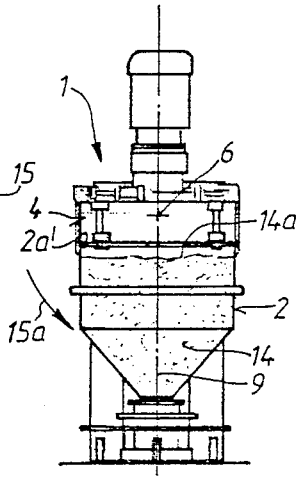

After this mixing operation the mixing vessel (2, 4) is then pivoted back out of the mixing position shown in FIG. 3 about the horizontal axis 6 with the aid of the pivot drive motor 13 with two different tilting speeds as described above into the starting position, the mixing vessel (2, 4) being pivoted according to the arrow 15 by a predetermined angle measurement (angle $\alpha$ in FIG. 5) beyond the vertical starting position (FIG. 4) into the intermediate position according to FIG. 5, and only from there back into the starting position according to FIG. 6 with a vertical axis (arrow 15*a*). In the intermediate position according to FIG. 5 the vessel axis 9 forms an acute angle $\alpha$ (angle measurement) with the vertical 16 which should be greater than the angle $\beta$ which the surface of the bulk material charge 14 forms with respect to the vertical because of the natural slope of the mixed bulk material, as indicated in FIG. 4. While the mixing vessel is resting in the intermediate position according to FIG. 5, the upper quantities of the bulk material charge 14 slide down because of the natural embankment or slope into a position in which the surface 14*a* of the bulk material charge 14 is substantially parallel to a horizontal plane passing through the upper filling end 2*a*′ of the first mixing vessel part 2, as can be seen in FIGS. 5 and 6—after levelling off the bulk material embankment—and by comparison with the unlevelled bulk material embankment or surface 14*a*′ of the bulk material charge 14 according to FIG. 4.

The angle measurement $\alpha$ for the intermediate position can be chosen to be in the range between approximately 35° and 55°, preferably approximately 45°, adapted to the natural slope angle of the bulk material in question.

We claim:

1. A method of mixing powdered or granular material contained within a mixing vessel comprising:

(a) rotating said vessel in one direction through substantially 180° about a substantially horizontal axis from an initial position in which said vessel has a substantially vertical axis to a mixing position;

(b) mixing said material in said mixing position;

(c) rotating said vessel in the opposite direction from said mixing position past said initial position by a predetermined angle to an intermediate position;

(d) maintaining said vessel in said intermediate position a predetermined period of time; and (e) rotating said vessel in said one direction from said intermediate position to return said vessel to said initial position, (f) the speed of rotation from said initial position to said mixing position being greater than the speed of rotation of said vessel from said mixing position to said intermediate position.

2. The method according to claim 1 including maintaining said mixing vessel in said intermediate position for such a period of time that when said vessel is returned to said initial position said material has its upper surface substantially horizontal.

3. The method according to claim 1 wherein the speed of rotation of said vessel to said intermediate position is such that when said vessel arrives at said intermediate position said material has its surface inclined to said vertical axis at an angle that is less than said predetermined angle.

4. A method of mixing powdered or granular material contained within a mixing vessel comprising:

(a) moving said vessel from an initial upright position in which a vertical plane passes through said vessel to an inverted mixing position;

(b) mixing said material while said vessel is in said mixing position;

(c) moving said vessel from said mixing position to an intermediate and partially upright position at a predetermined acute angle to said vertical plane;

(d) maintaining said vessel in said intermediate position for a predetermined period of time; and (e) returning said vessel to said initial position following the elapse of said predetermined period of time, (f) the speed of movement of said vessel from said mixing position to said intermediate position being greater than the speed of movement of said vessel from said initial position to said mixing position.

5. The method according to claim 4 wherein said vessel is moved in opposite directions from said initial position to said mixing position and from said mixing position to said intermediate position.

6. The method according to claim 4 wherein the speed of movement of said vessel to said intermediate position is such that when said vessel arrives at said intermediate position said material has its surface inclined to said vertical axis at an angle that is less than said predetermined acute angle.

7. The method according to claim 4 wherein said predetermined time period is between about 2 and 8 seconds.

8. The method according to claim 4 wherein said predetermined time period is between about 4 and 6 seconds.

9. The method according to claim 4 wherein said acute angle is between about 35° and 55°.

10. The method according to claim 4 wherein said acute angle is about 45°.

11. Apparatus for mixing powdered or granular material comprising:

(a) a mixing vessel for containing said material;

(b) means mounting said vessel for movement about a substantially horizontal axis;

(c) means for moving said vessel about said axis from an initial upright position to an inverted mixing position;

(d) means for mixing said material in said vessel at said mixing position;

(e) means for moving said vessel about said axis from said mixing position to an intermediate position angularly spaced from said initial position by an acute angle;

(f) and means for returning said vessel to said initial position from said intermediate position, (g) the speed of movement of said vessel from said mixing position to said intermediate position being less than the speed of movement of said vessel from said initial position to said mixing position.

12. The apparatus according to claim 11 wherein the means for moving said vessel from each of said positions to another of said positions comprises a reversible motor.

13. The apparatus according to claim 11 wherein said vessel moves in one direction about said axis from said initial position to said mixing position and in the opposite direction from said mixing position to said intermediate position.

14. The apparatus according to claim 13 wherein the distance from said initial position to said mixing position is greater than the distance from said initial position to said intermediate position.

15. The apparatus according to claim 11 including means for holding said vessel in said intermediate position for a predetermined time period.

16. The apparatus according to claim 15 wherein said time period is between about 2 and 8 seconds.

17. The apparatus according to claim 15 wherein said time period is between about 4 and 6 seconds.

18. The apparatus according to claim 11 wherein said material is such that when said vessel reaches said intermediate position its surface forms an angle to said vertical plane that is smaller than said acute angle.

19. The apparatus according to claim 11 wherein said acute angle is between about 35° and 55°.

* * * * *